US011056301B2

(12) United States Patent
Miyakawa et al.

(10) Patent No.: US 11,056,301 B2
(45) Date of Patent: Jul. 6, 2021

(54) PRESSURE SWITCH

(71) Applicant: Saginomiya Seisakusho, Inc., Tokyo (JP)

(72) Inventors: Satoshi Miyakawa, Saitama (JP); Tomohiro Sakakibara, Saitama (JP)

(73) Assignee: Saginomiya Seisakusho, Inc., Tokyo (JP)

( * ) Notice: Subject to any disclaimer, the term of this patent is extended or adjusted under 35 U.S.C. 154(b) by 0 days.

(21) Appl. No.: 16/744,847

(22) Filed: Jan. 16, 2020

(65) Prior Publication Data

US 2020/0243287 A1 Jul. 30, 2020

(30) Foreign Application Priority Data

Jan. 28, 2019 (JP) ..... JP2019-012328

(51) Int. Cl.
*H01H 35/26* (2006.01)
*H01H 35/34* (2006.01)

(52) U.S. Cl.
CPC ..... *H01H 35/34* (2013.01); *H01H 35/26* (2013.01)

(58) Field of Classification Search
CPC ..... H01H 35/34; H01H 35/346; H01H 35/38; H01H 35/32; H01H 35/26; H01H 35/30; H01H 35/343; F16L 317/004
USPC ..... 200/83, 81 R, 81.9 R, 83 B, 83 C, 82 R, 200/83 J, 275, 83 N
See application file for complete search history.

(56) References Cited

U.S. PATENT DOCUMENTS 3,588,395 A * 6/1971 Hersey ..... H01H 35/34 200/83 S
4,243,858 A * 1/1981 Place ..... H01H 35/34 200/284

(Continued)

FOREIGN PATENT DOCUMENTS

JP H02129639 U 10/1990
JP 11-025826 A 1/1999

(Continued)

OTHER PUBLICATIONS

Translation of JP2002-433207 (Original document filed Nov. 29, 2002) (Year: 2002).*

(Continued)

*Primary Examiner* — William A Bolton
(74) *Attorney, Agent, or Firm* — Quarles & Brady LLP

(57) ABSTRACT

A pressure switch is provided which enables an increased pressure tightness. A pressure switch comprises a diaphragm, a cap to define a storage space for pressure fluid, a plate-shaped stopper configured to limit a position of the diaphragm in the event of pressure variation to define a working position, a coupling section for coupling outer circumferences of the diaphragm, the cap and the stopper to form a diaphragm unit, a ring-shaped member formed with a substantially same diameter as the diaphragm unit, a switch element, and a body (a tubular section of a joint section and a switch holding tube) configured to accommodate the ring-shaped member and the diaphragm unit while clamping an outer circumference section of the diaphragm unit together with the ring-shaped member so that the ring-shaped member comes into pressure contact with the outer circumference section.

13 Claims, 6 Drawing Sheets

(56) References Cited

U.S. PATENT DOCUMENTS

| | | | | | |
|---|---|---|---|---|---|
| 4,458,117 | A * | 7/1984 | Johnson | H01H 35/2657 | 200/83 P |
| 4,540,860 | A * | 9/1985 | Odashima | H01H 35/2614 | 200/83 C |
| 4,581,509 | A * | 4/1986 | Sanford | H01H 35/34 | 200/302.1 |
| 5,109,603 | A * | 5/1992 | Boulanger | H01H 35/26 | 174/667 |
| 5,216,213 | A * | 6/1993 | Sato | H01H 9/047 | 200/302.1 |
| 2017/0169974 | A1 * | 6/2017 | Miyakawa | H01H 35/34 | |

FOREIGN PATENT DOCUMENTS

| | | | | |
|---|---|---|---|---|
| JP | 2002343207 | * | 11/2002 | H01H 35/34 |
| JP | 200359377 | A | 2/2003 | |

OTHER PUBLICATIONS

Japan Patent Office. Notice of Reasons for Refusal for application 2019-012328. dated May 11, 2021. With translation.

* cited by examiner

PRESSURE SWITCH

CROSS-REFERENCE TO RELATED APPLICATIONS

This application claims priority to Japanese Patent Application No. 2019-012328 filed Jan. 28, 2019, the disclosure of which is hereby incorporated by reference for all purposes.

BACKGROUND OF THE INVENTION

Technical Field

The present invention relates to a pressure switch configured to switch on and off depending on a pressure variation of pressure fluid.

Background Art

Conventionally, a pressure switch is used e.g. in the field of construction machinery. Control oil for a hydraulic machine is used as pressure fluid in the construction machinery field, wherein a pressure switch is known that is configured to receive a pressure variation of such pressure fluid by a diaphragm and switch a switch element on and off (see e.g. Patent Document 1).

Many of diaphragms for use in a pressure switch are members which have a thin plate shape and are configured to deflect in an out-of-plane direction depending on a pressure variation on a first surface of front and back surfaces. For such a pressure switch, the switch element is switched on and off depending on deflection of the diaphragm.

SUMMARY OF THE INVENTION

For a pressure switch used in the construction machinery field, pressure fluid under high pressure is often used. However, for conventional pressure switches, there is currently room for improvement regarding pressure tightness.

Therefore, focused on the above-mentioned problem, an objective of the present invention is to provide a pressure switch which enables an increased pressure tightness.

In order to achieve the objective as described above, a pressure switch according to the present invention is characterized by a diaphragm with a thin plate shape configured to deflect in an out-of-plane direction depending on pressure variation on a first surface of front and back surfaces, a cap to define a storage space for pressure fluid on a side of the first surface of the diaphragm, a plate-shaped stopper arranged facing a second surface of the diaphragm and configured to limit a position of the diaphragm in the event of the pressure variation to define a working position, a coupling section for coupling an outer circumference of each of the diaphragm, the cap and the stopper with each other to form a diaphragm unit, a ring-shaped member arranged on a side of the diaphragm unit facing the stopper and formed with a substantially same diameter as the diaphragm unit, a switch element configured to be switched on and off upon deflection of the diaphragm, and a body configured to accommodate the ring-shaped member and the diaphragm unit while clamping an outer circumference section of the diaphragm unit together with the ring-shaped member so that the ring-shaped member comes into pressure contact with the outer circumference section, wherein the outer circumference section includes at least the coupling section.

According to a pressure switch of the present invention, the outer circumference section of the diaphragm unit is clamped together with the ring-shaped member by the body so that the ring-shaped member comes into pressure contact with the outer circumference section. Therefore, even if the stopper tries to deflect away from the cap in the outer circumference section of the diaphragm unit by introducing the pressure fluid into the storage space of the diaphragm unit, such deformation is limited by the ring-shaped member. Furthermore, according to a pressure switch of the present invention, the interior and exterior of the storage space have a substantially same pressure since the diaphragm unit is accommodated by the body, wherein occurrence of differential pressures itself is suppressed which would cause deformation which moves the cap away from the stopper in the outer circumference section of the diaphragm unit. In this manner, a pressure switch according to the present invention can achieve an increased pressure tightness since deformation of the stopper and the cap can be suppressed in the outer circumference section of the diaphragm unit where stress due to the differential pressure as described above tends to be concentrated when introducing the pressure fluid into the storage space.

Preferably, a pressure switch according to the present invention is configured so that the body includes a first body which is a bottomed tube with an introduction opening for the pressure fluid in a bottom wall and configured to accommodate the ring-shaped member and the diaphragm unit, and a second tubular body configured to fit to an opening side of the first body so as to clamp the ring-shaped member and the outer circumference section of the diaphragm unit to the bottom wall of the first body.

According to this configuration, the outer circumference section of the diaphragm unit where stress tends to be concentrated is clamped together with the ring-shaped member to the bottom wall of the first body and the second body. With this clamping structure, deformation of the stopper and the cap in the outer circumference section of the diaphragm unit can be suppressed still better.

More preferably, this pressure switch is configured so that a crimped section is provided in one of the first and the second body so as to press an opening edge of the second body in an axial direction of the second body against the outer circumference section of the ring-shaped member, wherein the crimped section is crimped to another of the first and the second body.

With this configuration, the outer circumference section of the diaphragm unit can be clamped to the bottom wall of the first body while pressing the outer circumference section intensively with the opening edge of the second body via the ring-shaped member. With this intensively pressing structure, deformation of the stopper and the cap in the outer circumference section of the diaphragm unit can be suppressed still better.

More preferably, this pressure switch is configured so that a seal member is provided which tightly contacts an inner circumferential surface of one of the first and the second body as well as an outer circumferential surface of another of the first and the second body.

With this configuration, simply arranging a single seal member between the first body and the second body can effectively suppress water intrusion from a point between them.

Preferably, a pressure switch according to the present invention is configured so that the ring-shaped member is made of metal and formed with a thickness larger than the stopper.

With this preferred pressure switch, deformation of the stopper in the outer circumference section of the diaphragm unit as described above unit can be suppressed more effectively by a metal member with a larger thickness and with a larger strength, i.e. the ring-shaped member.

With a pressure switch according to the present invention, the pressure tightness can be increased since deformation of the stopper and the cap can be suppressed by clamping the ring-shaped member and the outer circumference section of the diaphragm unit with the body as well as by accommodating the diaphragm unit into the body.

DETAILED DESCRIPTION OF THE PREFERRED EMBODIMENTS

Hereinafter, an embodiment of the present invention shall be described.

Figure 1:
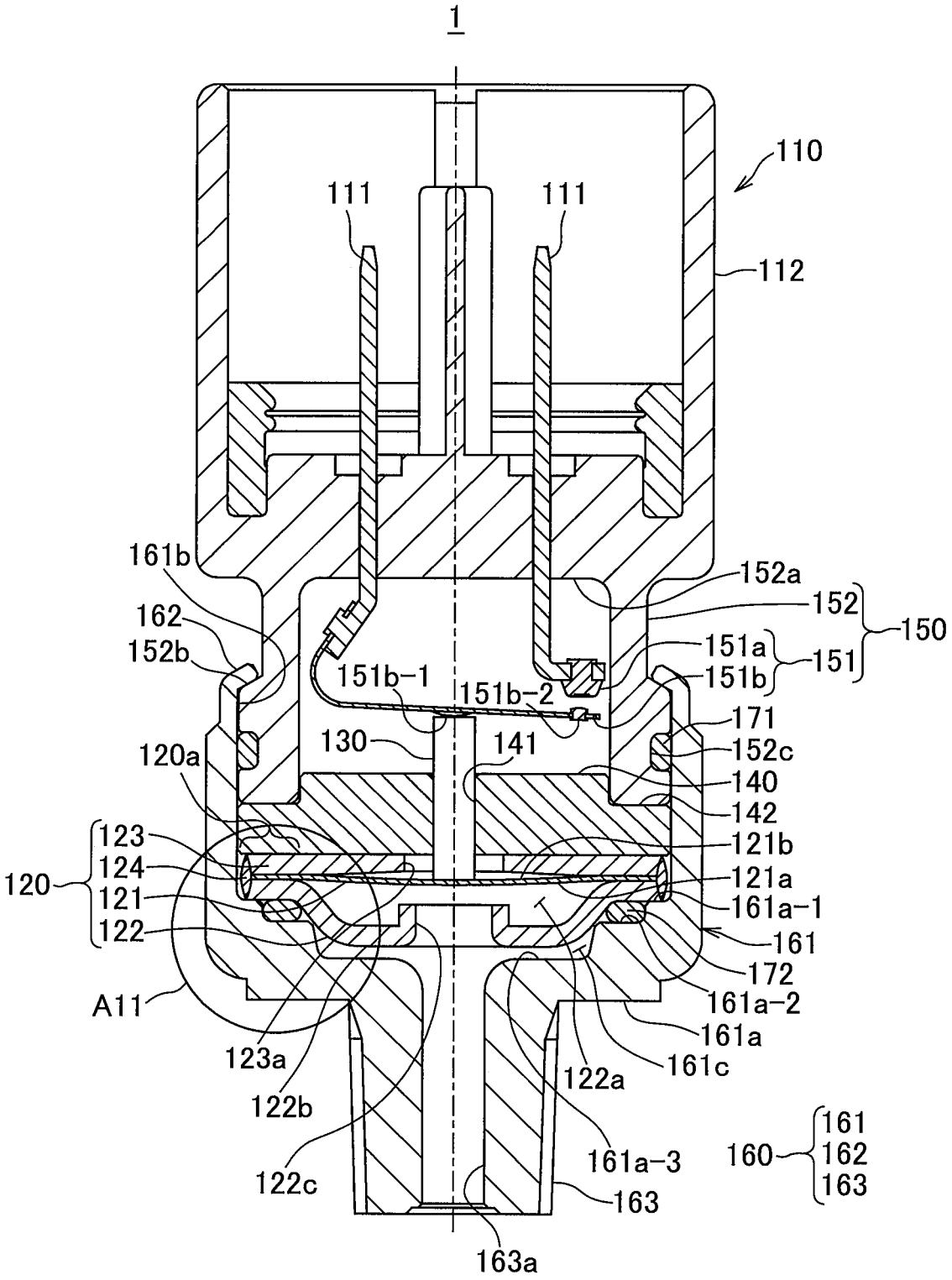
FIG. 1 is a schematic view of a pressure switch according to an embodiment of the present invention.
Figure 2:
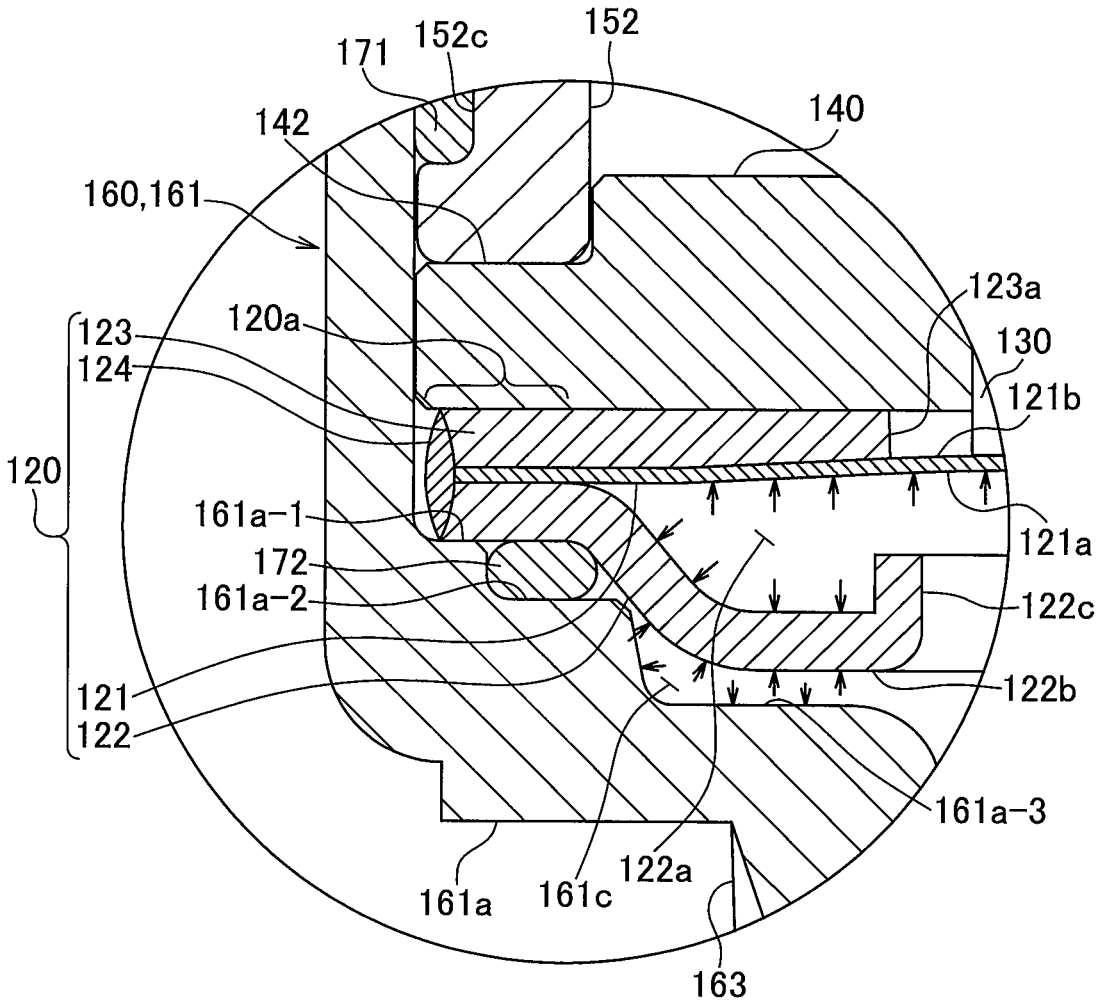
FIG. 2 is an enlarged view of a region A11 in FIG. 1 with the diaphragm changed in another state.

FIG. 1 is a schematic view of a pressure switch according to an embodiment of the present invention. Furthermore, FIG. 2 is an enlarged view of a region A11 in FIG. 1 with the diaphragm in another state.

A pressure switch 1 according to the present embodiment is configured to connect two terminals 111 of a connector 110 conductively to each other and disconnect them depending on pressure variation of pressure fluid, wherein the pressure switch 1 is used for detecting pressure fall e.g. due to oil leakage in the case of control oil for a hydraulic machine as pressure fluid. Applications of the pressure switch 1 according to the present embodiment also include e.g. state monitoring of a pilot hydraulic pressure. In this case, an output of the pressure switch 1 is used as a trigger e.g. for issuing an alarm and/or stopping operation of a device when the pilot hydraulic pressure deviates from a target pressure. According to the present embodiment, the pressure switch 1 is further a normally-open switch which is configured so that the two terminals 111 are disconnected from each other without being under pressure. In addition thereto, the pressure switch 1 is under pressure in normal operation of the hydraulic machine and the two terminals 111 are connected conductively to each other. When a pressure fall occurs in the control oil which is larger than an acceptable amount, the two terminals 111 are disconnected from each other. This pressure switch 1 includes a diaphragm unit 120, an operation shaft 130, a ring-shaped member 140, a switch holder 150 which is integral with a connector 110, and a joint section 160.

The diaphragm unit 120 includes a diaphragm 121, a cap 122, a stopper 123 and a coupling section 124.

The diaphragm 121 is a member which is formed from metal in a thin plate shape and configured to deflect in an out-of-plane direction depending on a pressure variation on a first surface 121*a* of front and back surfaces. The diaphragm 121 deflects to be inverted between two states, i.e. a convex state in which a second surface 121*b* is convex, and a concave state in which the second surface 121*b* is concave. In the normal operation of the hydraulic machine, the diaphragm 121 is in the convex state, wherein the diaphragm 121 changes over into the concave state when a pressure fall larger than an acceptable amount occurs in the control oil as the pressure fluid. FIG. 1 shows the diaphragm 121 in the concave state, and FIG. 2 shows the diaphragm 121 in the convex state.

The cap 122 is a dish-shaped member which is made of metal and defines a storage space 122*a* for the pressure fluid on a side of the first surface 121*a* of the diaphragm 121. For the cap 122, a portion which corresponds the inside of the dish forms the storage space 122*a*. Furthermore, an introduction opening 122*c* for the pressure fluid is formed at a center of a bottom wall 122*b* of the cap 122.

The stopper 123 is arranged facing the second surface 121*b* of the diaphragm 121 and configured to limit a change-over position of the diaphragm 121 in the convex state in the event of the pressure variation to define a working position (a position of the diaphragm 121 at which the switch element switches on and off). This stopper 123 is a plate-shaped member which is made of metal and provided with a passage hole 123*a* for the operation shaft 130. The passage hole 123*a* for the operation shaft 130 is provided at a center of the stopper 123. And the stopper 123 is shaped with a thickness which is decreased gradually from a position spaced to a predetermined extent from an outer edge of the stopper 123, to the passage hole 123*a* so that the stopper 123 is located away from the second surface 121*b* of the diaphragm 121 in the concave state. As shown in FIG. 2, the diaphragm 121 is capable of changing over into the convex state until the second surface 121*b* comes into contact with the stopper 123.

The coupling section 124 is a section which couples an outer circumference of each of the diaphragm 121, the cap 122 and the stopper 123 with each other by means of welding to form the diaphragm unit 120. This coupling section 124 is formed into a ring shape by overlapping three members together, i.e. the diaphragm 121, the cap 122 and the stopper 123 and then by outer circumferential welding and thus melting them.

The operation shaft 130 is provided with its one end being in contact with the second surface 121*b* of the diaphragm 121 and made of an insulating material (e.g. ceramics).

The ring-shaped member 140 is arranged on a side of the diaphragm unit 120 facing the stopper 123 and formed with a substantially same diameter as the diaphragm unit 120. This ring-shaped member 140 is a block member made of metal which is formed with a thickness larger than the stopper 123 and provided with a guide hole 141 for the operation shaft 130. The guide hole 141 is a through hole provided at a center of the ring-shaped member 140 with a diameter slightly larger than the operation shaft 130, wherein the operation shaft 130 is movable so as to slide on an inner surface of this guide hole 141 and to be guided in its thickness direction.

The switch holder 150 is a member which is configured integrally with the above described connector 110 and holds a switch element 151 which is configured to switch on and off upon deflection of the diaphragm 121, more specifically upon movement of the operation shaft 130 with an inversion action. This switch holder 150 includes the switch element 151 and a switch holding tube 152 (second body).

The switch element 151 includes a fixed contact 151*a* fixed on an end of one of the two terminals 111 of the connector 110, and a leaf-spring-shaped movable contact 151*b* with one end fixed on an end of the other terminal 111.

This switch element 151 is positioned so that a middle section 151*b*-1 of the movable contact 151*b* comes into contact with a tip of the operation shaft 130 opposed to the diaphragm 121. When the diaphragm 121 is in the convex state, the tip of the operation shaft 130 raises the middle section 151*b*-1 of the movable contact 151*b* and the tip section 151*b*-2 of the movable contact 151*b* comes into contact with the fixed contact 151 so that the switch element 151 is switched into an on-state. On the other hand, when the diaphragm 121 is in the concave state, the middle section 151*b*-1 of the movable contact 151*b* is lowered following the lowered tip of the operation shaft 130, wherein the tip section 151*b*-2 of the movable contact 151*b* is separated away from the fixed contact 151*a* so that the switch element 151 is switched into an off-state.

The switch holding tube 152 opens at a side facing the diaphragm unit 120, wherein the switch holding tube 152 is a bottomed tubular body section made of resin which is formed integrally with a resin casing 112 of the connector 110 and accommodates the switch element 151 inside. For the two terminals 111 wherein the fixed contact 151*a* and the movable contact 151*b* of the switch element 151 are fixed to the respective ends of the terminals 111, the other end of each of the two terminals 111 extends through the bottom wall 152*a* of the switch holding tube 152 into the resin casing 112 of the connector 110.

The joint section 160 is a joint which is provided for connecting e.g. a not shown external pipeline for the pressure fluid, and accommodates the operation shaft 130, the ring-shaped member 140 and the diaphragm unit 120. The joint section 160 includes a tubular section 161 (first body), a crimped section 162, and a port section 163 for the pressure fluid.

The tubular section 161 is a bottomed tube made of metal with a bottom wall 161*a* provided with the port section 163 as an introduction opening for the pressure fluid. The tubular section 161 accommodates the operation shaft 130, the ring-shaped member 140 and the diaphragm unit 120 so that the switch holder 150 enters an opening 161*b* of the tubular section 161 and fits into it. An outer diameter of the switch holding tube 152 of the switch holder 150, an outer diameter of the ring-shaped member 140, and an outer diameter of the diaphragm unit 120 are substantially same with each other, wherein an inner diameter of the tubular section 161 is slightly larger than these outer diameters.

A stairs shape with a first step 161*a*-1, a second 161*a*-2, a bottom surface section 161*a*-3 is formed in an inner surface of the bottom wall 161*a* of the tubular section 161. The first step 161*a*-1 which is closest to an outer edge and located on the uppermost level supports a portion of the outer circumference section 120*a* of the diaphragm unit 120 closer to the coupling section 124 from a side of the cap 122. The second step 161*a*-2 which is adjacent to the first step 161*a*-1 and located on a middle level supports a portion of the outer circumference section 120*a* closer to the introduction opening 122*c* from the side of the cap 122 via a second O-ring 172 as described below. In the bottom surface section 161*a*-3 located on the lowermost level, a central introduction passage 163*a* is opened in the port section 163 and an outer storage space 161*c* is defined wherein a gap is formed to the cap 122 and the exterior of this cap 122 is filled with pressure fluid.

The crimped section 162 is provided at an end edge of the opening 161*b* in the tubular section 161. The crimped section 162 is crimped to the switch holding tube 152 so as to press an opening edge of the switch holding tube 152 in an axial direction of this switch holding tube 152 against an outer circumference section of the ring-shaped member 140. In this manner, the switch holding tube 152 fits to an opening side of the tubular section 161 so as to clamp the ring-shaped member 140 and the outer circumference section 120*a* of the diaphragm unit 120 to the bottom wall 161*a* of the tubular section 161. Then, the ring-shaped member 140 is in pressure contact with the outer circumference section 120*a* of the diaphragm unit 120.

A latch step 152*b* for latching the crimped section 162 is provided on an outer circumferential surface of the switch holding tube 152. The crimped section 162 is latched at this latch step 152*b* and crimped so as to press the switch holding tube 152 downwards in FIG. 1. In this manner, the crimped section 162 is crimped so as to press the opening edge of the switch holding tube 152 in the axial direction of the switch holding tube 152 against the outer circumference section of the ring-shaped member 140.

Furthermore, an outer circumferential step 142 is formed in a portion of the ring-shaped member 140 corresponding to the outer circumference section 120*a* of the diaphragm unit 120, the outer circumferential step 142 being provided for receiving the opening edge of the switch holding tube 152. Once the crimped section 162 is crimped, the opening edge of the switch holding tube 152 is pressed against this outer circumferential step 142 of the ring-shaped member 140. And a portion of the outer circumference section 120*a* of the diaphragm unit 120 closer to the coupling section 124 is clamped together with the outer circumferential step 142 of the ring-shaped member 140 by the above mentioned first step 161*a*-1 and the opening edge of the switch holding tube 152. Additionally, a portion of the outer circumference section 120*a* of the diaphragm unit 120 closer to the introduction opening 122*c* is clamped together with the outer circumferential step 142 of the ring-shaped member 140 by the above mentioned second step 161*a*-2 and the opening edge of the switch holding tube 152 via the second O-ring 172.

According to the present embodiment, the tubular section 161 of the joint section 160 (first body) and the switch holding tube 152 (second body) form a body of the pressure switch 1 which accommodates the operation shaft 130, the ring-shaped member 140 and the diaphragm unit 120 while clamping the outer circumference section 120*a* of the diaphragm unit 120 together with the ring-shaped member 140 so that the ring-shaped member 140 comes into pressure contact with the outer circumference section 120*a*.

The port section 163 of the joint section 160 is a tube made of metal which is provided integrally with the tubular section 161 so that the introduction passage 163*a* for pressure fluid is aligned coaxially with the introduction opening 122*c* in the cap 122 of the diaphragm unit 120. A thread is formed on an outer circumferential surface of the port section 163, the thread being provided for connecting an external pipeline for pressure fluid which is not shown. Pressure fluid introduced through this introduction passage 163*a* of the port section 163 fills the storage space 122*a* inside the cap 122 and the outer storage space 161*c* outside the cap 122.

Furthermore, according to the present embodiment, a first O-ring 171 (seal member) is provided which tightly contacts an outer circumferential surface of the switch holding tube 152 of the switch holder 150 as well as an inner circumferential surface of the tubular section 161 of the joint section 160. A fitting groove 152*c* for this first O-ring 171 is formed in the outer circumferential surface of the switch holding tube 152, wherein the first O-ring 171 tightly contacts the inner circumferential surface of the tubular section 161, being fitted into this fitting groove 152*c*.

In addition, according to the present embodiment, the second O-ring 172 is interposed between an outer surface of a portion of the cap 122 of the outer circumference section 120*a* of the diaphragm unit 120 closer to the introduction opening 122*c* and the second step 161*a*-2 of the bottom wall 161*a* of the tubular section 161. The second O-ring 172 is in a state where it tightly contacts the outer surface of the cap 122 as well as the second step 161*a*-2.

In the pressure switch 1 according to the above described embodiment, when pressure fluid is introduced into the storage space 122*a* in the diaphragm unit 120, a differential pressure is generated which may separate the stopper 123 and the cap 122 from each other to expand the storage space 122*a*. Stresses due such a differential pressure tend to be concentrated in the outer circumference section 120*a* of the diaphragm unit 120 including the coupling section 124 and tries to cause deformation in the outer circumference section 120*a* wherein the deformation may separate the stopper 123 and the cap 122 from each other. In this case, with the pressure switch 1 according to the present embodiment, the deformation in the outer circumference section 120*a* is suppressed by action e.g. of the ring-shaped member 140 as described below.

Hereinafter, a pressure switch as a reference example for comparison with the pressure switch 1 according to the present embodiment will be described first, prior to description of such deformation suppression in the pressure switch 1 according to the present embodiment.

Figure 3:
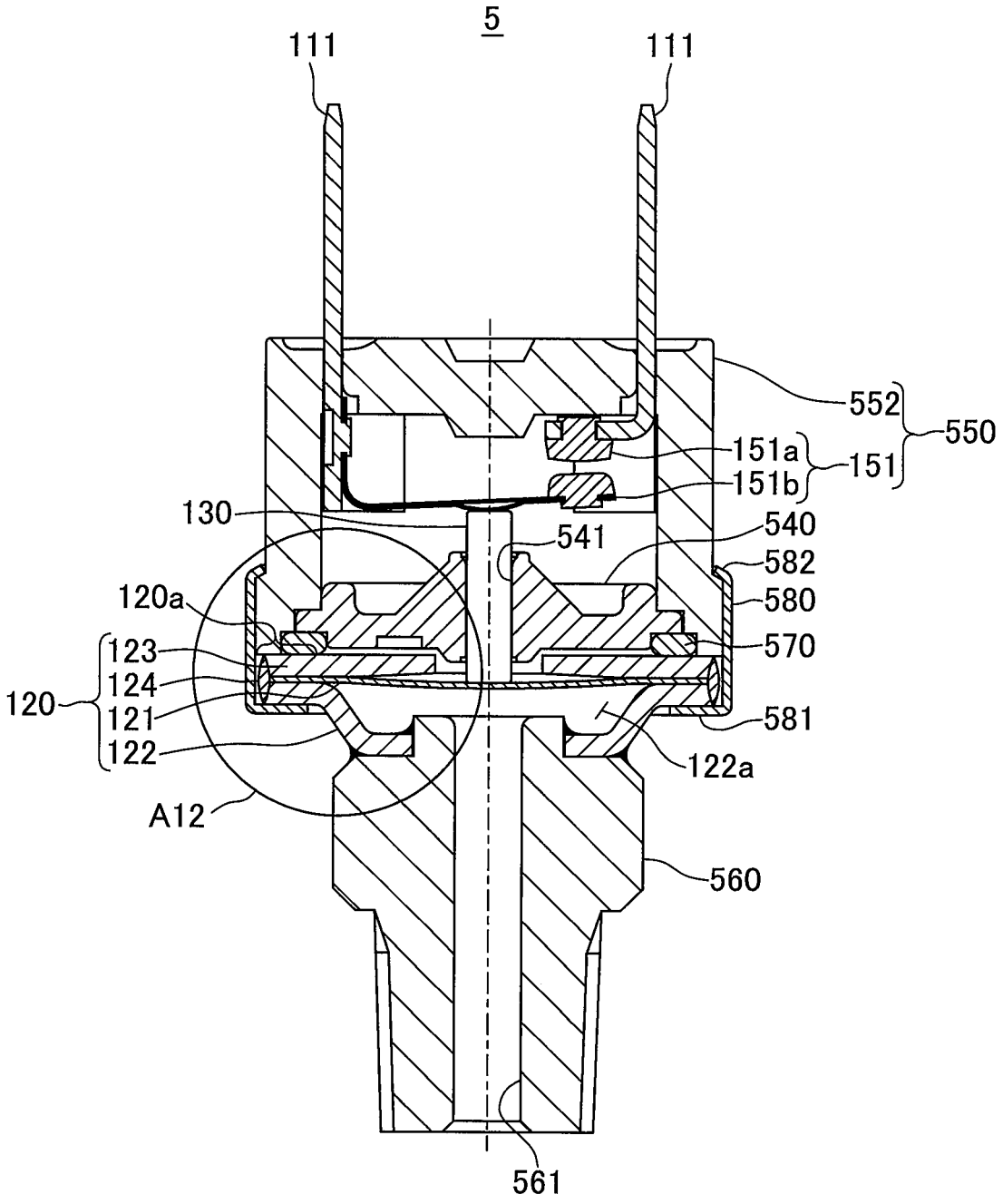
FIG. 3 is a schematic view of a pressure switch as a reference example for comparison with the pressure switch in FIGS. 1 and 2.
Figure 4:
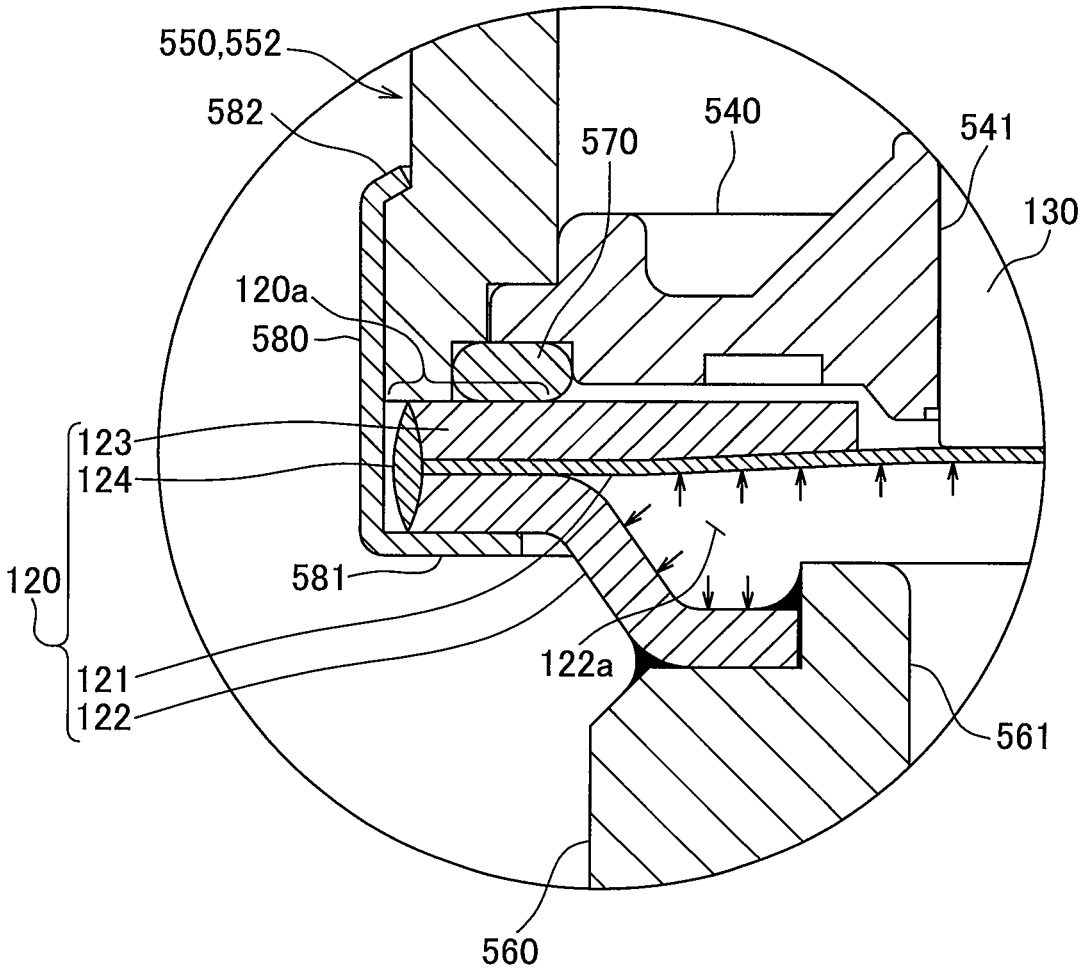
FIG. 4 is an enlarged view of a region A12 in FIG. 3 with the diaphragm in another state.

FIG. 3 is a schematic view of a pressure switch as a reference example for comparison with the pressure switch in FIGS. 1 and 2. FIG. 4 is an enlarged view of a region A12 in FIG. 3 with the diaphragm in another state. It is to be noted that features substantially equivalent to those shown in FIGS. 1 and 2 which may have some difference in shape etc. are provided with the same reference signs as those in FIGS. 1 and 2, wherein repeating the explanation of the equivalent features will be omitted in the following description.

Similarly, this pressure switch 5 of the reference example is configured to connect two terminals 111 conductively to each other and disconnect them via a switch element 151 depending on pressure variation of pressure fluid. However, for the pressure switch 5 of the reference example, a fixed contact 151*a* and a movable contact 151*b* of a switch element 151 are fixed to the respective ends of the two terminals 111, wherein the other end of each of the two terminals 111 extends out of a switch holding tube 552 of a switch holder 550. Switching on and off the switch element 151 is performed by a diaphragm unit 120 with a diaphragm 121, a cap 122, a stopper 123 and a coupling section 124 in a similar manner to the pressure switch 1 shown in FIGS. 1 and 2.

Here, for the pressure switch 5 of the reference example, the ring-shaped member 140 shown in FIGS. 1 and 2 is replaced by a guide member 540 for the operation shaft 130 so that the guide member 540 fits into an opening of the switch holding tube 552. This guide member 540 is a member which serves for guiding movement of the operation shaft 130 literally, wherein the guide member 540 has a portion with a guide hole 541 for the operation shaft 130 which has a larger thickness, while the guide member 540 has also several regions with a smaller thickness. Furthermore, the guide member 540 is not in pressure contact with an outer circumference section 120*a* of the diaphragm unit 120, but an O-ring 570 is interposed therebetween.

With regard to the diaphragm unit 120, its outer circumference section 120*a* is fixed to the switch holding tube 552 via a cover member 580 so as to be pressed against an opening edge of the switch holding tube 552. The cover member 580 is a tube member made of metal, wherein the switch holding tube 552 is fitted into one opening of the cover member 580, and a holding wall 581 protrudes from the other opening of the cover member 580, the holding wall 581 being provided for holding a lower surface of the cap 122 in the outer circumference section 120*a* of the diaphragm unit 120. With the outer circumference section 120*a* of the diaphragm unit 120 being held by the holding wall 581, a crimped section 582 provided at the opening into which the switch holding tube 552 is fitted is crimped to an outer circumferential surface of the switch holding tube 552.

A central portion of the cap 122 in the diaphragm unit 120 is exposed out of the cover member 580, wherein this exposed portion is fixed integrally to a joint section 560 with an introduction passage 561 for pressure fluid via blazing. The introduction passage 561 of the joint section 560 opens into a storage space 122*a* for pressure fluid in the diaphragm unit 120, wherein pressure fluid is introduced through this introduction passage 561 into the storage space 122*a*.

According to the pressure switch 5 of the reference example as described above, when pressure fluid is introduced into the storage space 122*a*, stress concentrated in the outer circumference section 120*a* including the coupling section 124 tries to cause deformation in the outer circumference section 120*a* due to a differential pressure between the inside and the outside of the storage space 122*a*, wherein the deformation would separate the stopper 123 and the cap 122 from each other. Furthermore, since the cap 122 according to the pressure switch 5 of the reference example is exposed in atmospheric air, a differential pressure tends to be large between a pressure of pressure fluid within the storage space 122*a* and an atmospheric pressure outside the storage space 122*a*. In this case, according to the pressure switch 5 of the reference example, the outer circumference section 120*a* of the diaphragm unit 120 is merely clamped by the opening edge of the resin switch holding tube 552 and the holding wall 581 of the thin-walled cover member 580. Only with this configuration, the stopper 123 and the cap 122 in the outer circumference section 120*a* may be deformed depending on a magnitude of a pressure of the pressure fluid etc., wherein there is room for improvement regarding pressure tightness.

In contrast to this pressure switch 5 of the reference example, the outer circumference section 120*a* of the diaphragm unit 120 in the pressure switch 1 according to the embodiment in FIGS. 1 and 2 is clamped together with the ring-shaped member 140 so that the ring-shaped member 140 comes into pressure contact with the outer circumference section 120*a*. Therefore, even if the stopper 123 in the outer circumference section 120*a* tries to deform itself in a direction away from the cap 122, such deformation can be suppressed by the ring-shaped member 140. In addition, since the diaphragm unit 120 according to the present embodiment of the pressure switch 1 is accommodated in the tubular section 161 of the joint section 160, the inside and the outside of the storage space 122*a* in the cap 122 are filled with pressure fluid. This result in a substantially same pressure inside and outside the storage space 122*a*, and thus, occurrence of differential pressures itself is suppressed which would cause deformation which moves the cap 122 away from the stopper 123 in the outer circumference section 120*a* of the diaphragm unit 120. In this manner, according to the present embodiment of the pressure switch 1, deformation of the stopper 123 and the cap 122 can be suppressed when introducing pressure fluid, which can increase pressure tightness.

According to the present embodiment, the outer circumference section 120*a* of the diaphragm unit 120 where stress tends to be concentrated is clamped between the switch holding tube 152 and the bottom wall 161*a* of the tubular section 161 of the joint section 160. This clamping structure enables deformation of the stopper 123 and the cap 122 in the outer circumference section 120*a* of the diaphragm unit 120 to be suppressed still better.

Moreover, according to the present embodiment, the crimped section 162 is crimped so as to press the opening edge of the switch holding tube 152 in the axial direction of the switch holding tube 152 against the outer circumferential step 142 which is the outer circumference section of the ring-shaped member 140. This embodiment enables the outer circumference section 120*a* of the diaphragm unit 120 to be pressed intensively with the opening edge of the switch holding tube 152 via the ring-shaped member 140 and simultaneously clamped to the bottom wall 161*a* of the tubular section 161. This intensively pressing structure enables deformation of the stopper 123 and the cap 122 in the outer circumference section 120*a* of the diaphragm unit 120 to be suppressed still better.

Additionally, according to the present embodiment, the first O-ring 171 is provided which tightly contacts the outer circumferential surface of the switch holding tube 152 as well as the inner circumferential surface of the tubular section 161 of the joint section 160. This embodiment enables e.g. water intrusion from a point between the outer circumferential surface of the switch holding tube 152 and the inner circumferential surface of the tubular section 161 to be suppressed effectively by a simple configuration with a single member, i.e. the first O-ring 171, arranged between the two surfaces.

Furthermore, according to the present embodiment, the second O-ring 172 is provided which tightly contacts the outer circumference section 120*a* of the diaphragm unit 120 as well as the bottom wall 161*a* of the tubular section 161. This embodiment enables e.g. pressure fluid leakage from a point between the outer circumference section 120*a* of the diaphragm unit 120 and the bottom wall 161*a* of the tubular section 161 to be effectively suppressed by a simple configuration with a single member, i.e. the second O-ring 172, arranged between the two surfaces.

Moreover, according to the present embodiment, the ring-shaped member 140 is a member made of metal which is formed with a thickness larger than the stopper 123. This embodiment enables deformation of the stopper 123 in the outer circumference section 120*a* of the diaphragm unit 120 as described above to be more effectively suppressed by a member with a high strength, i.e. the ring-shaped member 140, which is made of metal and formed with a larger thickness.

Next, exemplar variations for the pressure switch 1 according to the present embodiment shall be described by means of two examples.

Figure 5:
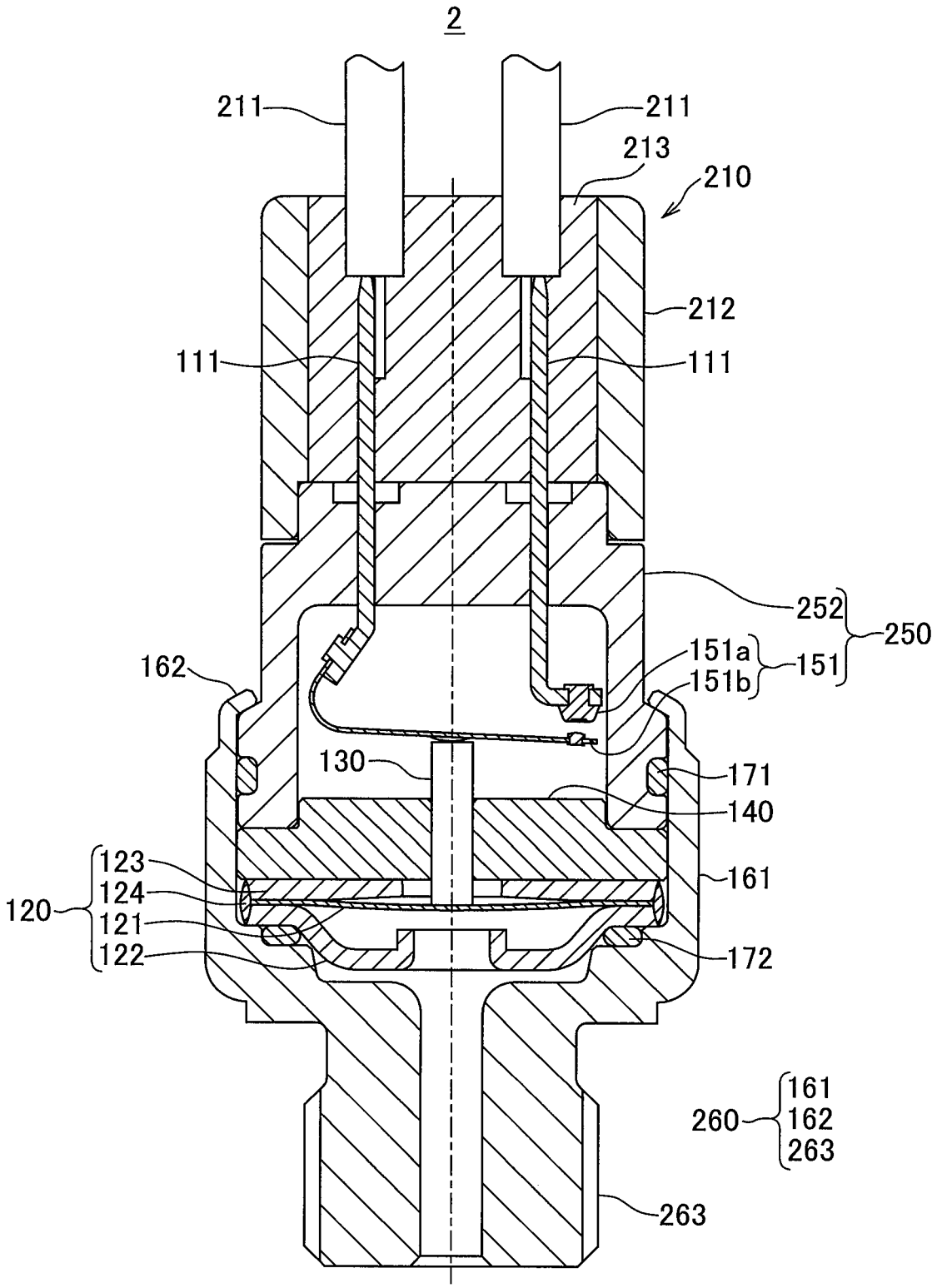
FIG. 5 is a schematic view of a pressure switch according to a first exemplar variation of the pressure switch in FIGS. 1 and 2.

FIG. 5 is a schematic view of a pressure switch according to a first exemplar variation of the pressure switch in FIGS. 1 and 2. It is to be noted that features in FIG. 5 equivalent to those shown in FIGS. 1 and 2 are provided with the same reference signs as those in FIGS. 1 and 2, wherein repeating the explanation of the equivalent features will be omitted in the following description.

A pressure switch 2 according to this first exemplar variation is configured to connect two electric wires 211 to each other conductively and disconnect them via a switch element 151 depending on pressure variation of pressure fluid. The two electric wires 211 are connected to two terminals 111 in a one-to-one manner, wherein a fixed contact 151*a* and a movable contact 151*b* of the switch element 151 are fixed to the respective ends of the two terminals 111.

In the pressure switch 2 according to the first exemplar variation, the other end of each of the two terminals 111 extends out of a switch holding tube 252 in a switch holder 250. Additionally, an electric wire holder 210 is provided so as to cover connected portions between these extending-out terminals 111 and the electric wires 211. The electric wire holder 210 includes a tubular casing 212 made of resin which encloses the connected portions between the terminals 111 and the electric wires 211, and a filling compound 213 of insulating resin with which the interior of the tubular casing 212 is filled.

Similarly, switching on and off the switch element 151 in the pressure switch 2 according to the first exemplar variation is performed by a diaphragm unit 120 with a diaphragm 121, a cap 122, a stopper 123 and a coupling section 124.

However, a port section 263 in a joint section 260 of the pressure switch 2 according to the first exemplar variation differs from the port section 163 of the pressure switch 1 shown in FIGS. 1 and 2. The port section 263 of the pressure switch 2 according to the first exemplar variation has a diameter larger than the port section 163 shown in FIGS. 1 and 2 and a different size of a thread formed on its outer circumferential surface.

In this manner, the pressure switch 2 according to the first exemplar variation has a structure e.g. of a tubular section 161 of the joint section 260 which has a role as a core of pressure tightness, as well as the internal diaphragm unit 120 ring-shaped member 140, which is common with those of the pressure switch 1 shown in FIGS. 1 and 2. On the other hand, on an output side of the switch element 151, the connector 110 shown in FIGS. 1 and 2 is replaced by the two electric wires 211 through the electric wire holder 210. Additionally, an introduction side for pressure fluid is modified depending on e.g. an external pipeline for pressure fluid which is not shown.

It is obvious that the pressure switch 2 according the first exemplar variation as described above also enables an increased pressure tightness by the structure common with the pressure switch 1 shown in FIGS. 1 and 2.

Figure 6:
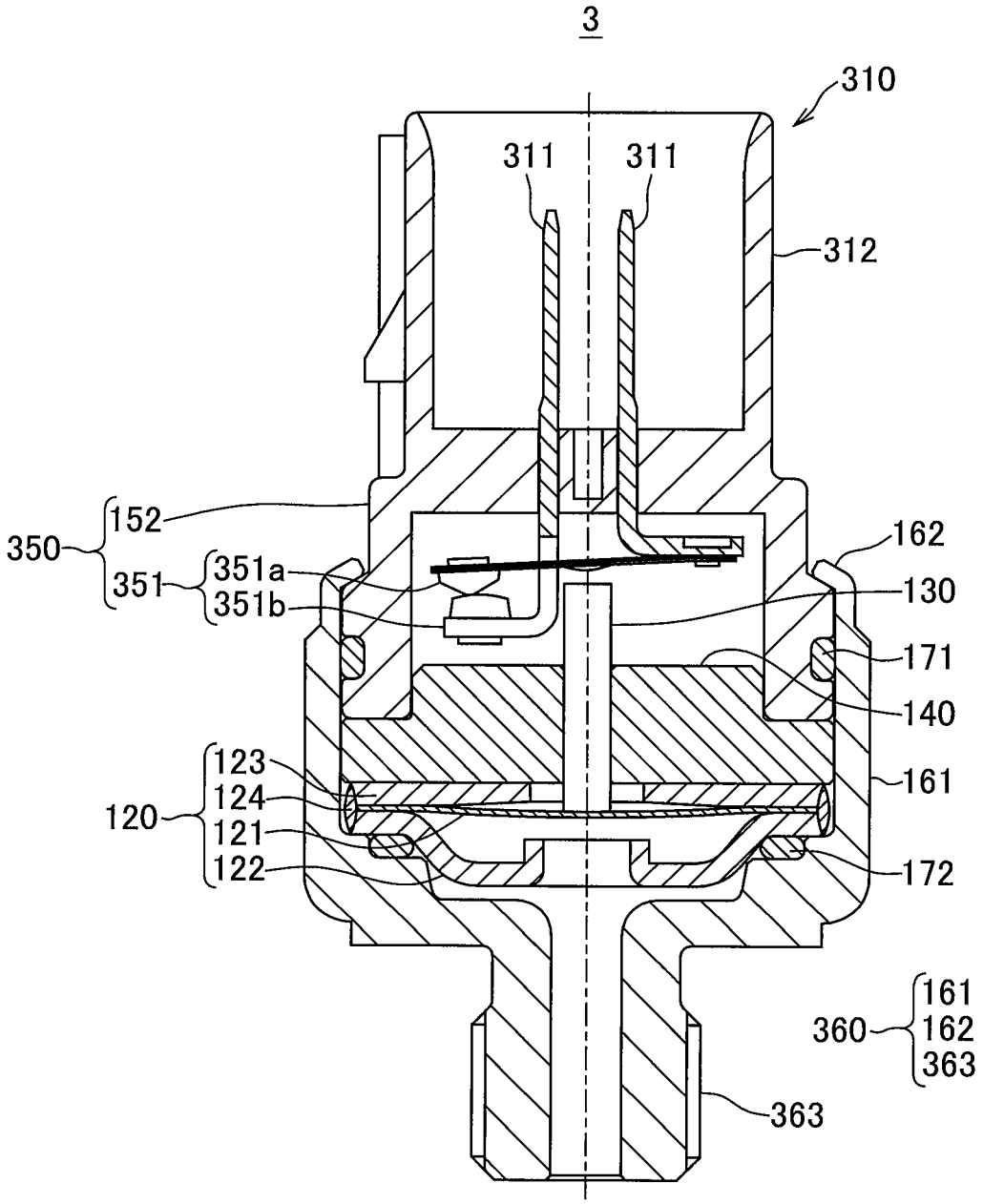
FIG. 6 is a schematic view of a pressure switch according to a second exemplar variation of the pressure switch in FIGS. 1 and 2.

FIG. 6 is a schematic view of a pressure switch according to a second exemplar variation of the pressure switch in FIGS. 1 and 2. It is to be noted that features in FIG. 6 equivalent to those shown in FIGS. 1 and 2 are provided with the same reference signs as those in FIGS. 1 and 2 as well, wherein repeating the explanation of the equivalent features will be omitted in the following description.

Similarly to the pressure switch 1 shown in FIGS. 1 and 2, the pressure switch 3 according to the second exemplar variation is configured to connect two terminals 311 of a connector 310 to each other conductively and disconnect them depending on pressure variation of pressure fluid. Similarly, the pressure switch 3 according to the second exemplar variation is used e.g. for detecting pressure fall of control oil for a hydraulic machine as pressure fluid. However, the pressure switch 3 according to the second exemplar variation is configured as a normally-closed switch wherein the two terminals 311 are connected to each other conductively without being under pressure, wherein in normal operation of the hydraulic machine, the pressure switch 3 is under pressure and the two terminals 311 are disconnected from each other. When a pressure fall occurs in the control oil which is larger than an acceptable amount, the two terminals 311 are connected conductively to each other. Accordingly, according to the pressure switch 3 of the second exemplar variation, arrangement of a fixed contact 351*a* and a movable contact 351*b* of a switch element 351 in a switch holder 350 is adapted for normally-closed types. Furthermore, according to the pressure switch 3 of the second exemplar variation, a resin casing 312 for accommodating the two terminals 311 has a shape different from that of the pressure switch 1 according to the first exemplar variation.

On the other hand, similarly in the pressure switch 3 according to the second exemplar variation, switching on and off the switch element 351 is performed by a diaphragm unit 120 with a diaphragm 121, a cap 122, a stopper 123 and a coupling section 124.

Moreover, similarly to the pressure switch 2 of the first exemplar variation as described above, a port section 363 of a joint section 360 in the pressure switch 3 according to the second exemplar variation differs from the port section 163 of the pressure switch 1 shown in FIGS. 1 and 2. This means that the port section 363 of the pressure switch 3 according to the second exemplar variation has a diameter larger than the port section 163 shown in FIGS. 1 and 2 and a different size of a thread formed on its outer circumferential surface as well.

In this manner, the pressure switch 3 according to the second exemplar variation has a structure e.g. of a tubular section 161 of the joint section 360 which has a role as a core of pressure tightness, as well as the internal diaphragm unit 120 ring-shaped member 140, which is common with those of the pressure switch 1 shown in FIGS. 1 and 2. On the other hand, the switch element is replaced by the normally-closed switch element 351. Additionally, an introduction side for pressure fluid is modified depending on e.g. an external pipeline for pressure fluid which is not shown.

It is obvious that the pressure switch 3 according the second exemplar variation as described above also enables an increased pressure tightness by the structure common with the pressure switch 1 shown in FIGS. 1 and 2.

Furthermore, as described by showing the two exemplar variations in FIGS. 5 and 6, pressure tightness is increased with the common structure which has the role as a core of pressure tightness, while structural features such as a type of switch, the output side and the port section can be easily modified.

It is to be noted that the embodiments and the exemplary variations as described above merely show representative configurations for the present invention and the present invention is not limited thereto. I.e., the embodiments and the exemplary variations may be modified and implemented within a scope which does not depart from the core of the present invention. It is obvious that such modifications are also included in the scope of the present invention as far as they include features of a pressure switch according to the present invention.

For example, according to the embodiments and exemplar variations as described above, the pressure switches 1 and 3 with the output sides of their switch elements 151, 351 configured as connectors 110, 310 as well as the pressure switch 2 with the output side of its switch element configured as the electric wires 211 are illustrated as examples for the pressure switch according to the present invention. However, the pressure switch according to the present invention is not limited thereto, and it is not limited how the output side of the pressure switch is concretely configured. Furthermore, according to the embodiments and the exemplar variations as described above, the pressure switches 1, 2, 3 are illustrated as examples for the output component in which the connectors 110, 310 and/or the electric wire holding section 210 as examples for the output side components integrated with bodies such as the switch holding tubes 151, 252. However, the pressure switch according to the present invention is not limited thereto, but may be a switch in which the output side component is separate from the body.

Furthermore, according to the embodiments and the exemplar variations as described above, the pressure switches 1, 2 and 3 are illustrated as examples for the pressure switch according to the present invention in which the introduction side for pressure fluid is configured as the port section 163, 263, 363 with a thread formed on the outer circumferential surface of a metal tube. However, the pressure switch according to the present invention is not limited thereto, and it is not limited how the introduction side for pressure fluid is concretely configured. Moreover, according to the embodiments and the exemplar variations as described above, the pressure switches 1, 2 and 3 are illustrated as examples in which the port section 163, 263, 363 as an example for the introduction side component for pressure fluid is formed integrally with a body such as the tubular section 161 of the joint section 160, 260, 360. However, the pressure switch according to the present invention is not limited thereto, but may be a switch in which the introduction side component for pressure fluid is formed separately from and coupled with the body via a joint component.

Furthermore, according to the embodiments and the exemplar variations as described above, the diaphragm 121 is illustrated as an example for the diaphragm according to the present invention, the diaphragm 121 being configured to change over between the convex state and the concave state depending on pressure variation on the first surface 121*a*, wherein the second surface 121*b* is convex in the convex state and concave in the concave state. However, the diaphragm according to the present invention is not limited thereto, but may be any diaphragm which changes over between two of the convex state, the concave state and a flat state in which the second surface is flat. This means that the diaphragm may change over between the convex state and the flat state or between the flat state and the concave state.

Moreover, according to the embodiments and the exemplar variations as described above, the body where the ring-shaped member 140 and the outer circumference section 120*a* of the diaphragm unit 120 are clamped by two body components, i.e. the tubular section 161 and the switch holding tube 152, 252, is illustrated as an example for the body according to the present invention. However, the body according to the present invention may have any concrete body configuration which accommodates the ring-shaped member and the diaphragm unit etc. while clamping the outer circumference section together with ring-shaped member so that the ring-shaped member comes into pressure contact with at least the outer circumference section of the diaphragm unit. However, as described above, deformation of the stopper 123 and the cap 122 in the outer circumference section 120*a* of the diaphragm unit 120 can be suppressed still better by means of the clamping structure with the two body components.

Furthermore, according to the embodiments and the exemplar variations as described above, the tubular section 161 is illustrated as an example for the first body according to the present invention, the tubular section 161 being configured to accommodate the ring-shaped member 140 and the diaphragm unit 120. Additionally, the switch holding tube 152, 252 is illustrated as an example for the second body according to the present invention, the switch holding tube 152, 252 being configured to enter the opening 161*b* of the tubular section 161 and fit into it. However, the first and the second bodies according to the present invention are not limited thereto, but the second body may fit into the opening side of the first body so that the first body configured to accommodate the ring-shaped member and the diaphragm unit enters the second body.

Moreover, according to the embodiments and the exemplar variations as described above, two body components are illustrated as an example for configuration of the body according to the present invention which are the tubular section 161 of the joint section 160 the switch holding tube 152, 252 are integrated with each other by crimping in the crimped section 162. However, the body according to the present invention is not limited thereto, but the integration may be accomplished by methods other than crimping, such as threading and/or welding, even if a body configuration with two body components is utilized.

Furthermore, according to the embodiments and the exemplar variations as described above, the crimped section 162 is illustrated as an example for the crimped section according to the present invention, the crimped section 162 provided at the opening edge of the tubular section 161 of the joint section 160 and crimped to the switch holding tube 152. However, for the crimped section according to the present invention, the concrete installed position and the crimping configuration may be determined in any manner in which the crimped section is provided at one of two body components and crimped to the other of the two body components which constitute the body.

Moreover, according to the embodiments and the exemplar variations as described above, the pressure switch 1, 2, 3 with the first O-ring 171 is illustrated as an example for the pressure switch according to the present invention. The first O-ring 171 is a seal member which tightly contacts the outer circumferential surface of the switch holding tube 152 as well as the inner circumferential surface of the tubular section 161 of the joint section 160, 260, 360. However, the pressure switch according to the present invention is not limited thereto, but the seal member such as an O-ring may be installed in any manner, and the seal member itself is not limited to an O-ring. However, as described above, simply arranging a single member, i.e. the first O-ring 171 as described above, can effectively suppress e.g. water entering from a point between the outer circumferential surface of the switch holding tube 152 and the inner circumferential surface of the tubular section 161.

Furthermore, according to the embodiments and the exemplar variations as described above, the first O-ring 171 is illustrated as an example for the seal member according to the present invention, wherein the first O-ring 171 tightly contacts the inner circumferential surface of the tubular section 161 as the first body which accommodates the ring-shaped member 140 and the diaphragm unit 120, as well as the outer circumferential surface of the switch holding tube 152, 252 as the second body which fits into the opening side of the first body. However, the seal member according to the present invention is not limited thereto, but may tightly contact the first and the second body in any manner in which it tightly contacts an inner circumferential surface of one of the first and the second body and an outer circumferential surface of the other of the first and the second body.

Moreover, according to the embodiments and the exemplar variations as described above, the ring-shaped member 140 made of metal as a block member which is formed with a thickness larger than the stopper 123 is illustrated as an example for the ring-shaped member according to the present invention. However, the ring-shaped member according to the present invention is not limited thereto, but its material and shape etc. may be determined in any manner. However, as described above, utilizing the ring-shaped member 140 made of metal with the larger thickness can more effectively suppress deformation of the stopper 123 in the outer circumference section 120*a* of the diaphragm unit 120.

Furthermore, according to the embodiments and the exemplar variations as described above, the switch element 151, 351 is illustrated as an example for the switch element according to the present invention, wherein the switch element 151, 351 is switched on and off via the operation shaft 130 upon deflection of the diaphragm 121. However, the switch element according to the present invention is not limited thereto, but may e.g. directly receive the deflection of the diaphragm, wherein the concrete manner is not limited how the switch element receives the deflection of the diaphragm. Moreover, even if the switch element is switched via the operation shaft, the operation shaft is not limited to a ceramic shaft with a bar shape as shown like the operation shaft 130 according to the embodiments and the exemplar variations as described above, but its shape and material etc. may be determined in any manner.

REFERENCE SIGNS LIST

1, 2, 3 Pressure switch
110, 310 Connector
111, 311 Terminals
120 Diaphragm unit
120*a* Outer circumference section
121 Diaphragm
121*a* First surface
121*b* Second surface
122 Cap
122*a* Storage space
123 Stopper
123*a* Passage hole
124 Coupling section
130 Operation shaft
140 Ring-shaped member
141 Guide hole
150, 250, 350 Switch holder
151, 351 Switch element
152, 252 Switch holding tube (a portion of the body, the second body)
160, 260, 360 Joint section
161 Tubular section (a portion of the body, the first body)
161*c* Outer storage space
162 Crimped section
171 First O-ring (seal member)
172 Second O-ring

What is claimed is:

1. A pressure switch comprising:

a diaphragm with a thin plate shape configured to deflect in an out-of-plane direction depending on pressure variation on a first surface of front and back surfaces;

a cap to define a storage space for pressure fluid on a side of the first surface of the diaphragm;

a plate-shaped stopper arranged facing a second surface of the diaphragm and configured to limit a position of the diaphragm in an event of the pressure variation to define a working position, a coupling section for coupling an outer circumference of each of the diaphragm, the cap and the stopper with each other to form a diaphragm unit, a ring-shaped member arranged on a side of the diaphragm unit facing the stopper and formed with a substantially same diameter as the diaphragm unit, a switch element configured to be switched on and off upon deflection of the diaphragm, and a body configured to accommodate the ring-shaped member and the diaphragm unit while clamping an outer circumference section of the diaphragm unit together with the ring-shaped member so that the ring-shaped member comes into pressure contact with the outer circumference section, wherein the outer circumference section includes at least the coupling section;

wherein the body comprises:

a first body which is a bottomed tube with an introduction opening for the pressure fluid in a bottom wall and configured to accommodate the ring-shaped member and the diaphragm unit; and a second body having a tubular shape, the second body being configured to fit to an opening side of the first body so as to clamp the ring-shaped member and the outer circumference section of the diaphragm unit to the bottom wall of the first body, wherein a crimped section is provided in one of the first and the second body so as to press an opening edge of the second body in an axial direction of the second body against the outer circumference section of the ring-shaped member, wherein the crimped section is crimped to another of the first and the second body, and wherein the crimped section is located on an imaginary line extending through the coupling section in parallel to the axial direction, and the imaginary line extends through the ring-shaped member.

2. The pressure switch according to claim 1, wherein a seal member is provided which tightly contacts an inner circumferential surface of one of the first and the second body as well as an outer circumferential surface of another of the first and the second body.

3. The pressure switch according to claim 2, wherein the ring-shaped member is made of metal and formed with a thickness larger than the stopper.

4. The pressure switch according to claim 3, wherein the crimped section is located on an imaginary line extending through the coupling section in parallel to the axial direction.

5. The pressure switch according to claim 2, wherein the crimped section is located on an imaginary line extending through the coupling section in parallel to the axial direction.

6. The pressure switch according to claim 1, wherein the ring-shaped member is made of metal and formed with a thickness larger than the stopper.

7. The pressure switch according to claim 6 wherein the crimped section is located on an imaginary line extending through the coupling section in parallel to the axial direction.

8. The pressure switch according to claim 1, wherein the crimped section is provided in the first body.

9. The pressure switch according to claim 1, further comprising a latch step for latching the crimped section on an outer circumferential surface of the switch holding tube.

10. The pressure switch according to claim 9, wherein the crimped section is latched at the latch step.

11. The pressure switch according to claim 10, wherein the crimped section is crimped so as to press the opening edge of the switch holding tube.

12. The pressure switch according to claim 10, wherein the crimped section is crimped in the axial direction of the switch holding tube against the outer circumference section of the ring-shaped member.

13. The pressure switch according to claim 9, wherein the crimped section is crimped so as to press the switch holding tube downwards.

* * * * *